US006087909A

United States Patent [19]

Toda et al.

[11] Patent Number: 6,087,909

[45] **Date of Patent: *Jul. 11, 2000**

[54] DIELECTRIC FILTER HAVING AT LEAST ONE STEPPED RESONATOR HOLE WITH AN ELONGATED CROSS-SECTION

[75] Inventors: Jun Toda, Ishikawa-ken; Haruo Matsumoto, Kanazawa, both of Japan

[73] Assignee: Murata Manufacturing Co., Ltd., Japan

[ * ] Notice: This patent is subject to a terminal disclaimer.

[21] Appl. No.: 09/034,204

[22] Filed: Mar. 3, 1998

Related U.S. Application Data

[63] Continuation-in-part of application No. 08/612,027, Mar. 6, 1996, Pat. No. 5,742,214.

[30] Foreign Application Priority Data

Mar. 5, 1997 [JP] Japan ..... 9-050152
Dec. 15, 1997 [JP] Japan ..... 9-344747

[51] Int. Cl.[7] ..... H01P 1/20; H01P 1/202; H01P 1/213

[52] U.S. Cl. ..... 333/134; 333/206

[58] Field of Search ..... 333/202, 206, 333/207, 126, 132, 134, 202 DB

[56] References Cited

U.S. PATENT DOCUMENTS 5,124,676 6/1992 Ueno ..... 333/206
5,488,335 1/1996 Agahi-Kesheh et al. ..... 333/206
5,612,654 3/1997 Tsujiguchi et al. ..... 333/206 X
5,712,648 1/1998 Tsujiguchi ..... 333/134 X
5,742,214 4/1998 Toda et al. ..... 333/206 X
5,994,981 11/1999 Toda et al. ..... 333/206 X

FOREIGN PATENT DOCUMENTS 0731522 9/1996 European Pat. Off. .
9324968 12/1993 WIPO .

OTHER PUBLICATIONS

European Search Report dated Jun. 16, 1998.

*Primary Examiner*—Robert Pascal
*Assistant Examiner*—Barbara Summons
*Attorney, Agent, or Firm*—Ostrolenk, Faber, Gerb & Soffen, LLP

[57] ABSTRACT

A dielectric filter and a dielectric duplexer having a dielectric block with resonator holes formed therein, each having a large-sectional-area portion and a small-sectional-area portion so that the resonator hole has different respective inner diameters at an open-circuited end and a short-circuited end. Each large-sectional-area portion is formed with the cross-sectional shape of an elongated circle, an ellipse, or a rectangle, for example, the cross-sectional shape defining a longitudinal axis which is disposed at an angle against with respect to a plane in which the resonator holes are arranged. The invention increases the degree of freedom in providing a desired resonant frequency and a desired degree of coupling between resonators, in order to be able to easily provide desired filter characteristics, even in a case in which the external dimensions of the required dielectric block are restricted. Also disclosed is a method of manufacturing the dielectric filter and dielectric duplexer, as well as a radio transceiver utilizing the dielectric duplexer.

12 Claims, 8 Drawing Sheets

FIG. 12(A)
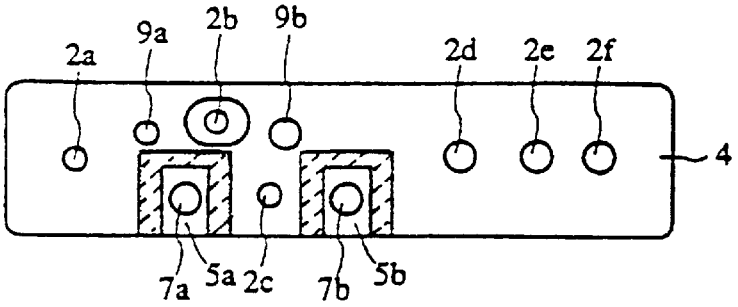
FIG. 12(B)
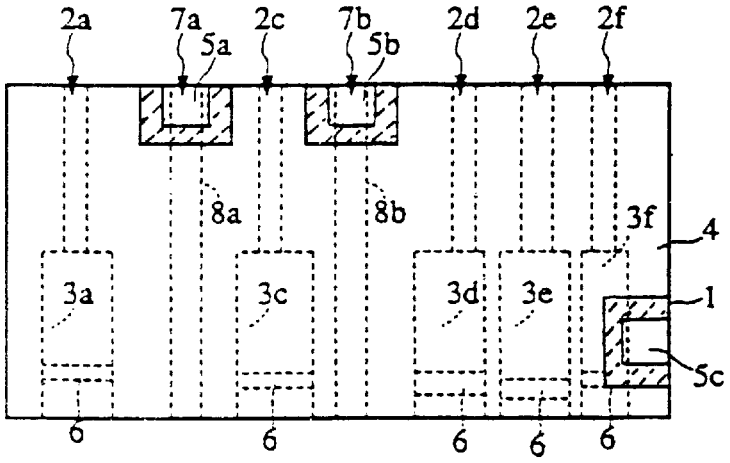
FIG. 12(D)
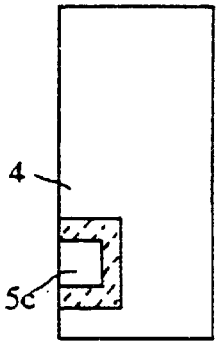
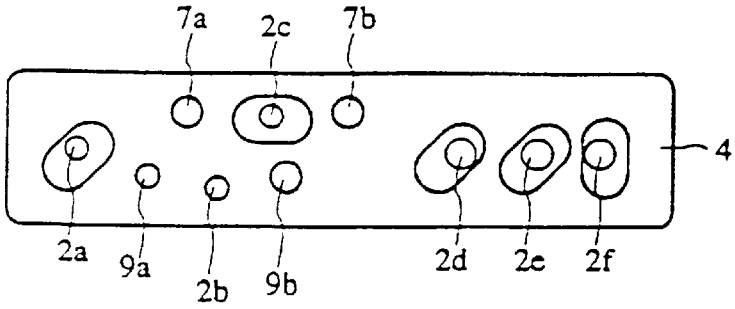
FIG. 12(C)

DIELECTRIC FILTER HAVING AT LEAST ONE STEPPED RESONATOR HOLE WITH AN ELONGATED CROSS-SECTION

This is a continuation-in-part of the present inventors' commonly-assigned U.S. patent application Ser. No. 08/612,027 filed Mar. 6, 1996, now U.S. Pat. No. 5,742,214 issued Apr. 21, 1998.

BACKGROUND OF THE INVENTION

1. Field of the Invention

The present invention relates to a dielectric filter and a dielectric duplexer, each said filter and duplexer having a plurality of resonator holes, including at least one resonator hole having two longitudinal portions with different cross-sectional areas arranged in a dielectric block.

The invention also relates to a method of manufacturing the dielectric filter and the dielectric duplexer.

The invention further relates to a radio transceiver utilizing the above-described dielectric duplexer.

2. Related Art of the Invention

A dielectric filter is known in which a plurality of resonator holes are provided in a single dielectric block and a change in the cross-sectional area of each hole is provided by changing the inner diameter of the hole in order to achieve coupling between resonators. In the filter, a line impedance of the resonator corresponding to each resonator hole changes at the boundary where the difference in cross-sectional area is formed.

Such a conventional dielectric filter has, for example, the structure shown in FIG. 14(A) and FIG. 14(B). FIG. 14(A) is a perspective view of the dielectric filter with the surface to be mounted on a circuit board being placed upwards. FIG. 14(B) is a view of the resonator holes viewed from one end of the dielectric block. This dielectric filter is formed of a substantially rectangular-parallelepiped-shaped dielectric block 1 in which two resonator holes 2*a* and 2*b* pass through one pair of opposing end surfaces of the block and have inner conductors 3 on their inner surfaces. Input and output electrodes 5 are formed on outer surfaces of the dielectric block 1, and an outer conductor 4 is formed on substantially all of the outer surfaces of the block except for the areas where the input and output electrodes 5 are formed.

Near one end surface 1*a*' of the dielectric block 1, a gap is formed in each of the inner conductors 3 in the resonator holes 2*a* and 2*b* so as to open-circuit (separate) the inner conductors 3 from the outer conductor 4 and so as to generate stray capacitances there. The inner conductors 3 are short-circuited (electrically connected) to the outer conductor 4 at the other end surface 1*b* of the dielectric block 1 and this end surface 1*b* will be referred to as a short-circuited end face.

The resonator holes 2*a* and 2*b* are provided with steps 21 in substantially halfway along the length thereof so that the inner diameters and cross-sectional areas of the holes change between the open end surface 1*a*' and the short-circuited end face 1*b*. Hereinafter, portions having a relatively larger inner diameter in the resonator holes are called large-sectional-area portions, and portions having a relatively smaller inner diameter are called small-sectional-area portions.

Since the large-sectional-area portions are formed at the open-circuited end in the structure shown in FIGS. 14(A)–14(B), a strong capacitive coupling is generally achieved between the two resonators and filter characteristics having a wide pass-band are obtained.

However, in the conventional dielectric filter described above, the fact that the large-sectional-area portion and the small-sectional-area portion of each resonator hole have circular cross-sections, and that their axes are aligned, places limitations on the degree of freedom in the design of the filter. That is, in practice, the resonant frequency of each resonator and the degree of coupling between the resonators are determined by setting the capacitance (hereinafter called self-capacitance) between each inner conductor and the outer conductor, and the capacitance (hereinafter called mutual capacitance) between the adjacent inner conductors. However, only the distance (pitch) between the resonator holes, the length ratio between the large-sectional-area portion and the small-sectional-area portion, and the inner-diameter ratio between the large-sectional-area portion and the small-sectional-area portion can be specified in this design. Thus, when the outside dimensions of the required dielectric block are restricted, it is difficult to obtain filter characteristics over a wide range, since only the above-mentioned measurements and ratios can be adjusted. Conversely, if a dielectric block satisfies the required filter characteristics, its outside dimensions may not fall in a desired range.

SUMMARY OF THE INVENTION

The present invention is able to solve such conventional problems and to provide a dielectric filter and a dielectric duplexer having an increased degree of freedom in the design of the resonant frequency and the degree of coupling between resonators, and a method of manufacturing the filter and duplexer.

The present invention provides a dielectric filter, comprising: a dielectric block having an open-circuited end and a short-circuited-end opposed to each other; an outer conductor disposed on an outer surface of said dielectric block; a plurality of resonator holes respectively extending from said open-circuited end to said short-circuited-end of said dielectric block, each hole having a respective inner surface on which an inner conductor is provided; at least one of said resonator holes comprising a large-sectional-area portion and a small-sectional-area portion having different respective inner cross-sectional areas. Advantageously the large-sectional-area portion is located at said open-circuited end and said small-sectional-area portion is located at said short-circuited-end. The cross-sectional shape of said large-sectional-area portion is substantially an elongated shape such as an elongated circle or ellipse, and the longitudinal direction of said cross-sectional shape being slanted with respect to the direction in which said plurality of resonator holes are arranged.

Since the cross-sectional shape of the large-sectional-area portion is substantially an elongated shape such as an elongated circle or ellipse, for example, when the large-sectional-area portion is placed at the open-circuited end, the self-capacitance at the open-circuited end is increased and the line impedance of the resonator at the open-circuited end is reduced. Therefore, the resonant frequency is reduced. Conversely, to obtain a desired resonant frequency, the length (axial length) of the dielectric block can be reduced. Another advantage of the cross-sectional shape of the large-sectional-area portion is that the opposing areas of adjacent inner conductors at the open-circuited end can be increased so as to increase the mutual capacitance at the open-circuited end, so that capacitive coupling between adjacent resonators is easily enhanced.

Since the longitudinal direction of the large-sectional-area portion is slanted with respect to the direction in which the plurality of resonators are arranged, when the tilt angle is changed, the self-capacitance at the large-sectional-area portion can be changed over a wide range. Even if the dimensions of the dielectric block are specified, the resonant frequency can be specified over a wide range. Conversely, to obtain a desired resonant frequency, the length of the dielectric block can be specified over a wide range. Also, when the tilt angle is changed, the mutual capacitance can be changed over a wide range so that the range of the degree of coupling between adjacent resonators can be extended.

In the above dielectric filter, the central axis of said small-sectional-area portion may be coaxial with the central axis of said large-sectional-area portion, or may be shifted so that said small-sectional-area portion is eccentric to said large-sectional-area portion.

When the central axis of the small-sectional-area portion is shifted from that of the large-sectional-area portion to be eccentric thereto, the distance between adjacent small-sectional-area portions is changed so that the mutual capacitance between the small-sectional-area portions is changed. When the small-sectional-area portions are disposed at the short-circuited end, for example, if the mutual capacitance at the small-sectional-area portion is reduced, inductive coupling between the resonators is weakened. Therefore, also in this respect, the degree of freedom in the design of the degree of coupling is increased.

The present invention further provides a dielectric duplexer including the above described dielectric filter, and further comprising; an input/output electrode, an input electrode, and an output electrode respectively provided on the outer surface of the dielectric block; some of the resonator holes in the filter being connected between said input/output electrode and said input electrode to define a transmission filter; and the others of the resonator holes being connected between said input/output electrode and said output electrode to define a receiving filter.

By the above structure, a duplexer having desired filter characteristics is easily obtained.

The present invention further provides a method of manufacturing the above-described dielectric filter or dielectric duplexer, comprising the steps of: adjusting the self-capacitance of each said resonator hole and the mutual capacitance between adjacent said resonator holes by changing the tilt angle of the longitudinal direction of the cross-section of the large-sectional-area portion with respect to the direction in which said plurality of resonator holes are arranged.

The above method may further comprise the steps of: adjusting the self-capacitance of each said resonator hole and the mutual capacitance between adjacent said resonator holes by changing the amount that the central axis of said small-sectional-area portion is shifted with respect to the central axis of said large-sectional-area portion.

The present invention further provides a radio transceiver including the above-described dielectric duplexer, further comprising: a transmission circuit connected to said input electrode for generating a transmission signal; a reception circuit connected to said output electrode for receiving a reception signal; and an antenna terminal connected to said input/output electrode for receiving an antenna.

The present invention further provides the above-described radio transceiver, wherein an antenna is connected to said input/output electrode via said antenna terminal.

BRIEF DESCRIPTION OF THE DRAWINGS

FIG. 12(A), FIG. 12(B) FIG. 12(C) and FIG. 12(D) show projective views of a dielectric duplexer according to a seventh embodiment.

Other features and advantages of the present invention will become apparent from the following description of embodiments of the invention which refers to the accompanying drawings.

DESCRIPTION OF EMBODIMENTS OF THE INVENTION

A structure and a manufacturing method for a dielectric filter according to a first embodiment of the present invention will be described below by referring to FIG. 1 to FIG. 3.

Figure 1:
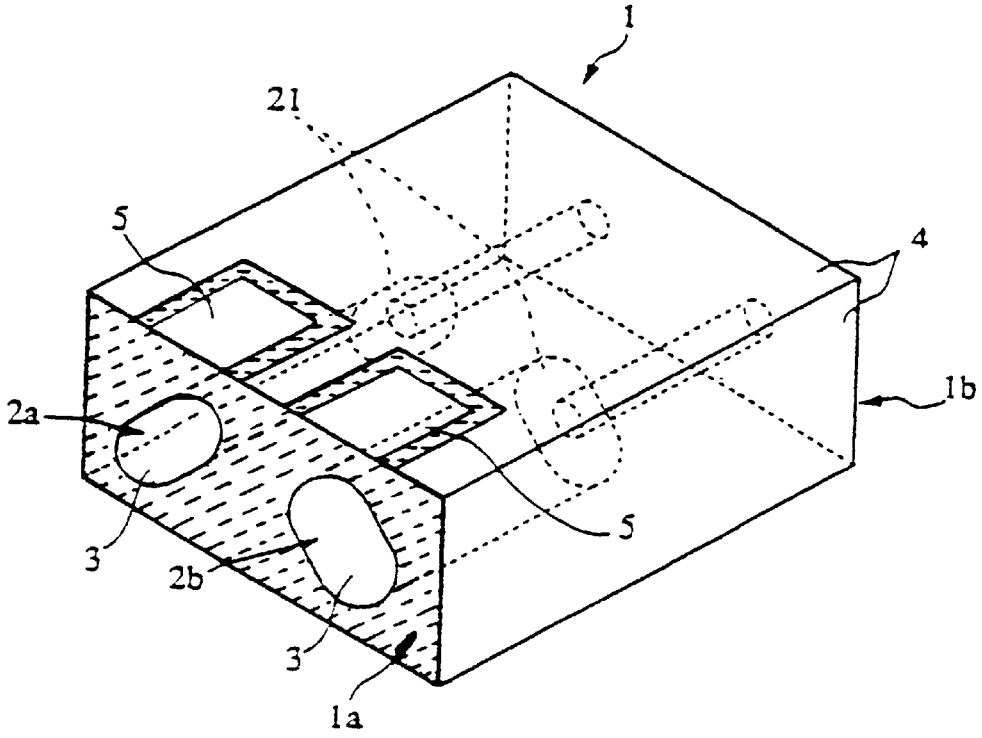
FIG. 1 shows a perspective view of a dielectric filter according to a first embodiment.

FIG. 1 is a perspective view with a surface to be mounted to a circuit board being placed upwards. This dielectric filter is formed of a substantially rectangular-parallelepiped dielectric block 1 in which resonator holes 2*a* and 2*b* pass through one pair of opposing surfaces of the block and have inner conductors 3 on their inner surfaces. Input/output electrodes 5 are formed on an outer surface of the dielectric block 1, and an outer conductor 4 is formed on the outer surface except for the areas where the input/output electrodes 5 are formed and except for one of said opposing surfaces la at which the open-circuited ends of the resonator holes 2*a* and 2*b* are located. Therefore, the surface 1*a* is referred to as an open end face, and the other end surface 1*b* serves as a short-circuited end face. As shown in the figure, the resonator holes 2*a* and 2*b* are provided with steps 21 at which their cross-sectional area changes substantially halfway along their length so that a large-sectional-area portion is disposed near the open-circuited end face 1*a* and a small-sectional-area portion is disposed near the short-circuited end face 1*b*.

Figure 2A:
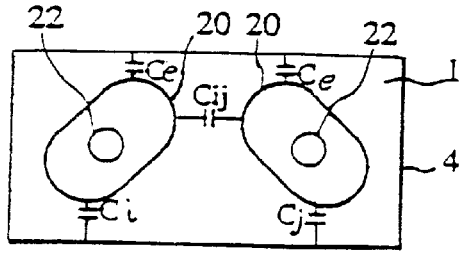
FIG. 2(A) and FIG. 2(B) show an elevation and a cross-section of the dielectric filter.
Figure 2B:
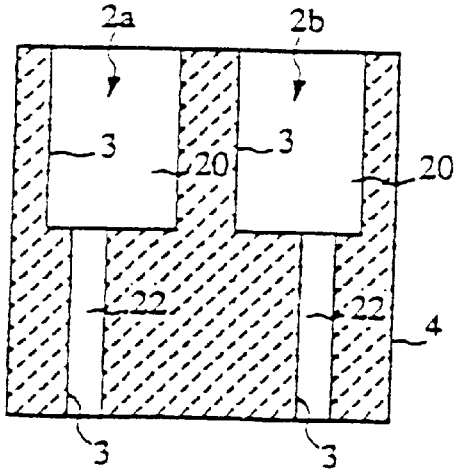

FIG. 2(A) and FIG. 2(B) show an elevation of the dielectric filter shown in FIG. 1, viewed from the open end, and a cross-section taken on a plane passing through the two resonator holes. As shown in FIG. 1, FIG. 2(A) and FIG. 2(B), the resonator holes 2*a* and 2*b* have their large-sectional-area portions 20 at the open-circuited end and their small-sectional-area portions 22 at the short-circuited end. The large-sectional-area portions 20 have an elongated circular cross-section (here, a combination of a rectangle and two semicircles, for example), when viewed in a plane perpendicular to their axes. The longitudinal axes of the cross-sections are slanted at specified angles with respect to a plane in which the two resonator holes 2*a* and 2*b* are arranged. As shown in FIG. 2(A), with this structure, self-capacitances Ci and Cj are generated between the outer conductor 4 and the inner conductors 3 at the open-circuited end, respectively. A mutual capacitance Cij is generated between the inner conductors of the adjacent resonators at the open-circuited end. In addition, external coupling capacitances Ce are generated between the input/output electrodes 5 and the inner conductors of the resonators at the open-circuited end.

Since the large-sectional-area portions 20 at the open-circuited end have the elongated circular cross-section, the self-capacitances are increased and the line impedances of the resonators at the open-circuited end are reduced. Therefore, the resonant frequency is reduced. Conversely, the use of the large-sectional-area portions enables the axial length of the dielectric block 1 to be reduced, without increasing the resonant frequency. Also, since the opposing areas of the adjacent inner conductors at the open-circuited end are increased, so as to increase the mutual capacitance, the capacitive coupling between the resonators is enhanced and the degree of coupling is increased. Also, the self-capacitances Ci and Cj change as a function of the angles at which the longitudinal directions of the large-sectional-area portions 20 are slanted with respect to the plane in which the resonator holes are arranged. With this, even if the cross-section of the large-sectional-area portions 20 is not changed, the resonant frequency or the axial length of the dielectric block can be changed. Since the mutual capacitance Cij also changes according to the tilt angles, the degree of coupling between the resonators can be specified over a wide range.

Figure 3A:
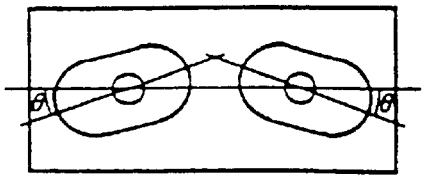
FIG. 3(A), FIG. 3(B), FIG. 3(C) and FIG. 3(D)show elevations of some dielectric filters having different tilt angles of the longitudinal axes of their large-sectional-area portions.
Figure 3B:
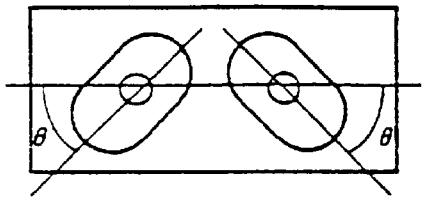
Figure 3C:
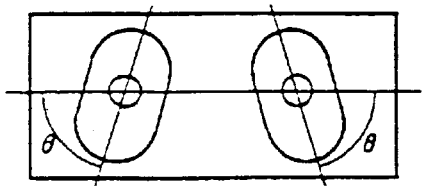
Figure 3D:
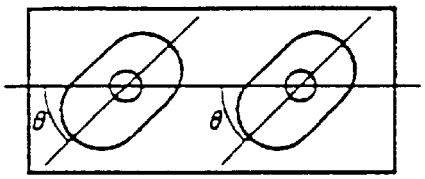

FIG. 3(A), FIG. 3(B), FIG. 3(*c*) and FIG. 3(D) show views of dielectric filters having different tilt angles, viewed from their open-circuited ends. Since the self-capacitances Ci and Cj and the mutual capacitance Cij change as the tilt angles of the longitudinal directions of the large-sectional-area portions change, even if the distance between the small-sectional-area portions of the adjacent resonator holes or the cross-sectional shape of the large-sectional-area portions does not change, the resonant frequencies of the resonators, the axial length of the dielectric block, or the degree of coupling between the adjacent resonators can be specified over a wide range.

Further, regarding the external coupling capacitances Ce between the input/output electrodes 5 and the inner conductors at the open-circuited end, it is clearly understood from FIG. 1 and FIGS. 2(A), 2(B) that they also change as the tilt angles of the large-sectional-area portions 20 change. With the use of this relationship, the desired external coupling capacitances Ce can be obtained by setting the tilt angles of the large-sectional-area portions 20 without changing the input and output electrodes 5. Therefore, as shown in FIG. 1, the invention also increases the degree of freedom in manufacturing external coupling capacitances in the dielectric filter in which the input and output electrodes generate the external coupling capacitances with the large-sectional-area portions formed in the dielectric block.

A structure and a manufacturing method for a dielectric filter according to a second embodiment of the present invention will be described below by referring to FIG. 4(A) to FIG. 6(B).

Figure 4A:
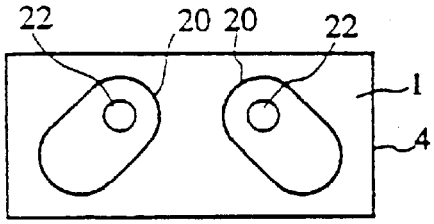
FIG. 4(A) and FIG. 4(B) show an elevation and a cross-section of a dielectric filter according to a second embodiment.
Figure 4B:
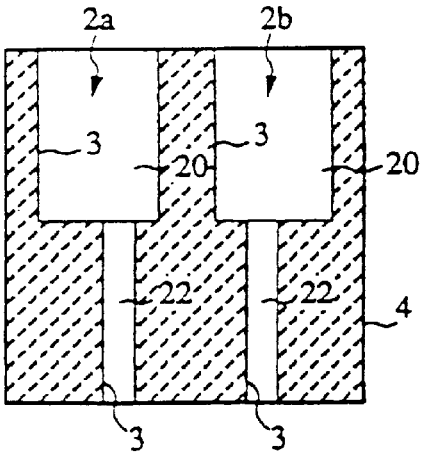

In the first embodiment, the central axes of the small-sectional-area portions of the resonator holes are aligned with the central axes of the large-sectional-area portions. In the second embodiment, the central axes of small-sectional-area portions are shifted from those of large-sectional-area portions to set the small-sectional-area portions eccentric to the large-sectional-area portions. For example, as shown in FIG. 4(A) and FIG. 4(B), the central axes of small-sectional-area portions 22 are set eccentric to those of large-sectional-area portions 20 such that the distance between two small-sectional-area portions 20 in adjacent resonator holes is reduced. With this structure, the mutual capacitance between the small-sectional-area portions at the short-circuited end increases, inductive coupling between the resonators is strengthened, and thereby capacitive coupling as a whole is reduced. The degree of coupling between the resonators is set to a low level.

Figure 5A:
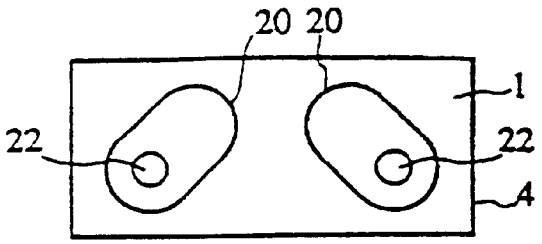
FIG. 5(A) and FIG. 5(B) show an elevation and a cross-section of another dielectric filter according to the second embodiment.
Figure 5B:
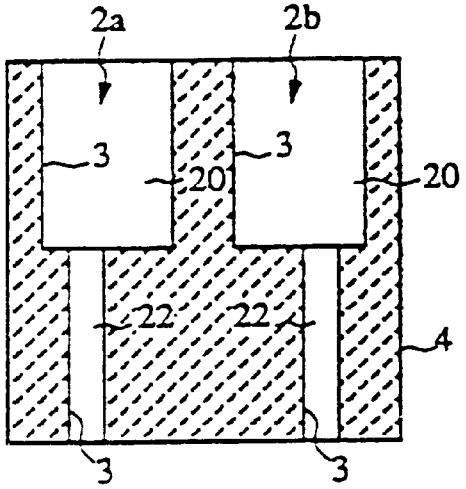

Conversely, for example, as shown in FIG. 5(A) and FIG. 5(B), the central axes of small-sectional-area portions 22 are set eccentric to those of large-sectional-area portions 20 such that the distance between two small-sectional-area portions 20 in adjacent resonator holes is increased. With this structure, the mutual capacitance between the small-sectional-area portions is reduced, inductive coupling between the resonators is reduced, and thereby capacitive coupling as a whole is increased. The degree of coupling between the resonators is set to a high level.

Figure 6A:
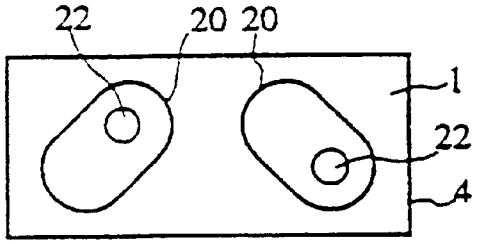
FIG. 6(A) and FIG. 6(B) show an elevation and a cross-section of still another dielectric filter according to the second embodiment.
Figure 6B:
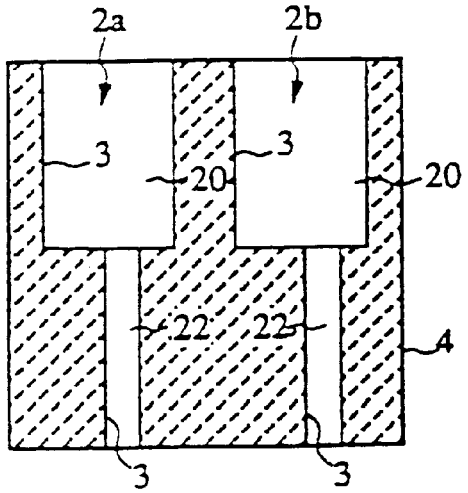

Also, the directions in which the central axes of small-sectional-area portions are shifted with respect to the central axes of large-sectional-area portions in respective adjacent resonator holes may be asymmetric as shown in FIG. 6(A) and FIG. 6(B).

Figure 7:
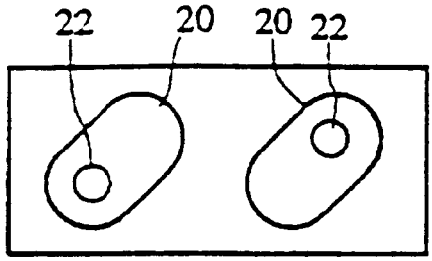
FIG. 7 shows an elevation of a dielectric filter according to a third embodiment.
Figure 8:
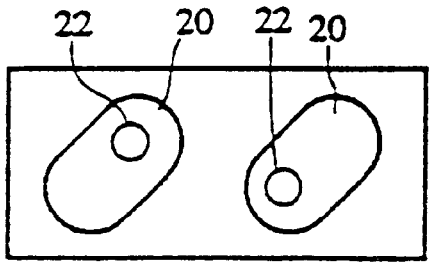
FIG. 8 shows an elevation of another dielectric filter according to the third embodiment.

FIG. 7 and FIG. 8 are elevational views of dielectric filters according to a third embodiment. Even if the tilt angles of the longitudinal axes of the large-sectional-area portions are the same in adjacent resonator holes, the mutual capacitance between the small-sectional-area portions can be changed by making the small-sectional-area portions eccentric.

Figure 9A:
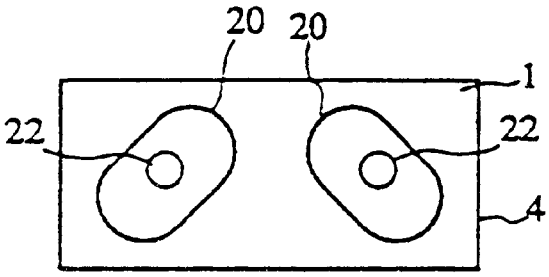
FIG. 9(A) and FIG. 9(B) show an elevation and a cross-section of a dielectric filter according to a fourth embodiment.
Figure 9B:
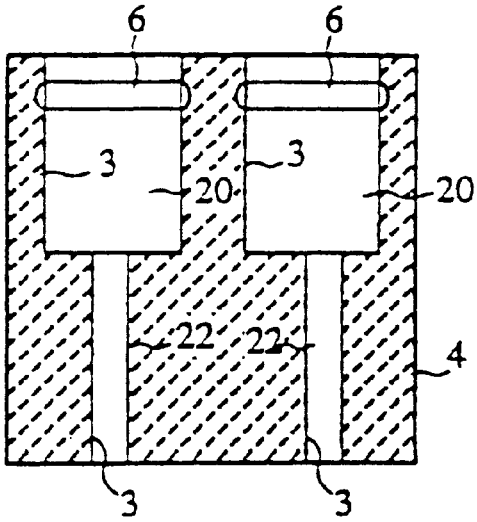
Figure 10A:
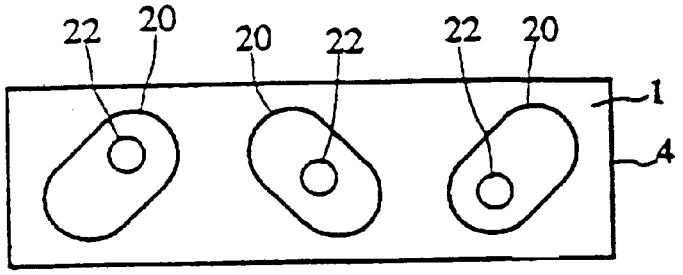
FIG. 10(A), FIG. 10(B), FIG. 10(C) and FIG. 10(D) show elevations of dielectric filters according to a fifth embodiment.
Figure 10B:
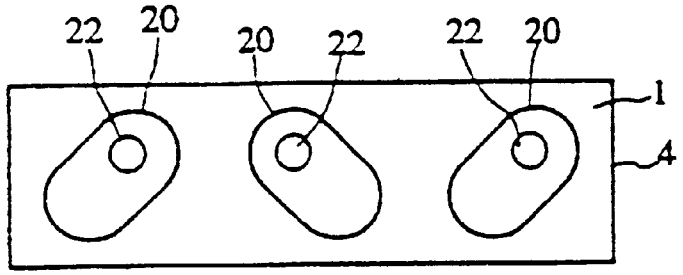
Figure 10C:
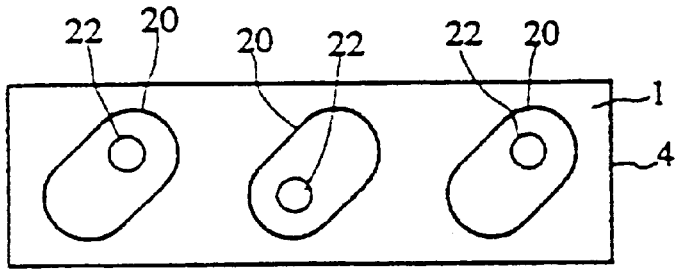
Figure 10D:
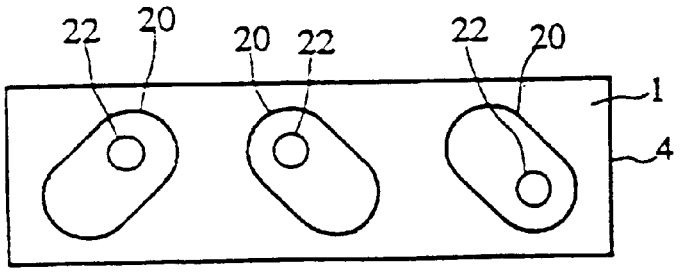

FIG. 9(A) and FIG. 9(B) show an elevation and a cross-section of a dielectric filter according to a fourth embodiment. In the first through third embodiments, one open end face of the dielectric block has no outer conductor. In the fourth embodiment, a dielectric filter may be configured as shown in FIG. 9(A) and FIG. 9(B) with respective gaps 6 where no conductors are formed near openings of the resonator holes so that open ends are formed inside the resonator holes. The gaps 6 may be formed by first forming inner conductors on the whole inner surfaces of the resonator holes, and then removing parts of the inner conductors at specified positions.

In the first through fourth embodiments, the large-sectional-area portions are placed at the open-circuited end and the small-sectional-area portions are placed at the short-circuited end. Conversely, a dielectric filter may be configured with large-sectional-area portions placed at the short-circuited end and the small-sectional-area portions placed at the open-circuited end. In this case, a change in a resonant frequency and a coupling relationship (whether it is capacitive coupling or inductive coupling) can be obtained by arrangements that are the reverse of those in the above embodiments.

FIGS. 10(A) to 10(D) are elevational views showing several dielectric filters according to a fifth embodiment. In the first through fourth embodiments, there are two resonators formed in the single dielectric block. The present invention can also be applied to a case in which three or more resonator holes are formed, by changing the self-capacitances and the mutual capacitance according to the tilt angles of the longitudinal axes of the large-sectional-area portions, and by changing the mutual capacitance according to the eccentric positions of the small-sectional-area portions. In the fifth embodiment, three resonator holes are provided and each resonator hole has a large-sectional-area portion 20 and a small-sectional-area portion 22. Even in a dielectric filter having such a structure, the desired filter characteristics can be obtained by appropriately specifying the tilt angles of the longitudinal directions of the large-sectional-area portion in each resonator hole, and the eccentric direction and eccentric distance of the small-sectional-area portion.

The structure of a dielectric duplexer according to a sixth embodiment will be described below by referring to FIG. 11(A) to 11(D).

Figure 11A:
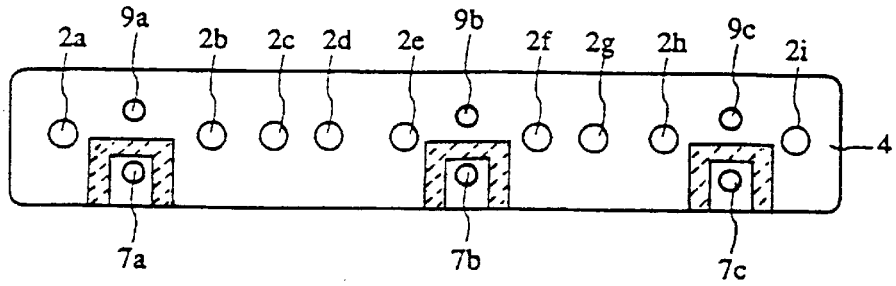
FIG. 11(A), FIG. 11(B), FIG. 11(C) and FIG. 11(D) show projective views of a dielectric duplexer according to a sixth embodiment.
Figure 11B:
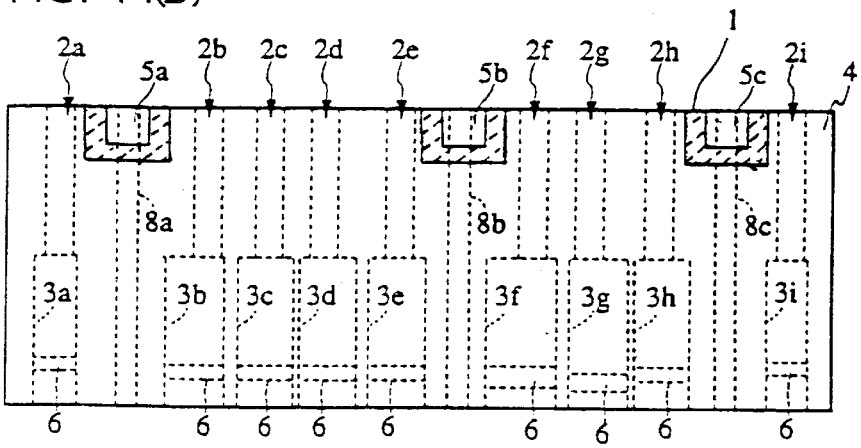
Figure 11D:
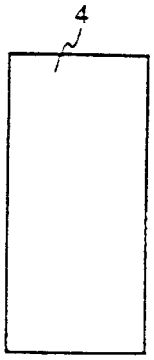
Figure 11C:
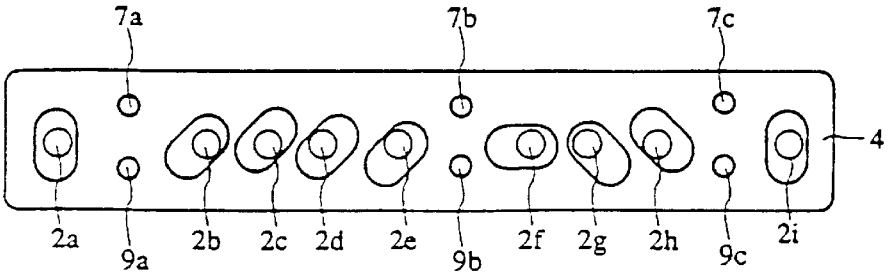

FIG. 11(A) to FIG. 11(D) show projective views of the dielectric duplexer. FIG. 11(A) is a plan, FIG. 11(B) is an elevation, FIG. 11(C) is a bottom view, and FIG. 11(D) is a right-hand side view of the dielectric duplexer. This dielectric duplexer is formed of a rectangular-parallelepiped dielectric block 1 in which various holes and conductors are made. Specifically, the block is provided with resonator holes 2*a*, 2*b*, 2*c*, 2*d*, and 2*e* for a receiving filter used when the dielectric duplexer serves as an antenna multiplexer, resonator holes 2*f*, 2*g*, 2*h*, and 2*i* for a transmission filter used when the dielectric duplexer serves as an antenna multiplexer, and input and output holes 7*a*, 7*b*, and 7*c*.

As shown in FIG. 11(B), each resonator hole is of a step type in which the inner diameter changes approximately halfway along the length of the resonator between the upper half and the lower half, and its inner surface is provided with an inner conductor. Inner conductors 3*a*, 3*b*, 3*c*, 3*d*, 3*e*, 3*f*, 3*g*, 3*h*, and 3*i* are formed on the inner surfaces of the resonator holes 2*a*, 2*b*, 2*c*, 2*d*, 2*e*, 2*f*, 2*g*, 2*h*, and 2*i*, respectively. Input-and-output inner conductors 8*a*, 8*b*, and 8*c* are formed on the inner surfaces of the input and output holes 7*a*, 7*b*, and 7*c*. In this embodiment, the input-and-output inner conductors 8*a*, 8*c*, and 8*b* correspond to an output electrode, an input electrode, and an input/output electrode according to the present invention, respectively. In each inner conductor, a gap 6 where no conductor is formed is provided near the end of the large-sectional-area side of the step hole and the gap 6 serves as an open end of the corresponding resonator.

Ground holes 9*a*, 9*b*, and 9*c* are also shown in the figure. They are straight, have a constant inner diameter, and are provided with conductors on the whole inner surfaces. On the outside surfaces of the dielectric block 1, input and output electrodes 5*a*, 5*b*, and 5*c* continuously connected to the input-and-output inner conductors 8*a*, 8*b*, and 8*c*, respectively, are formed, and an outer conductor 4 is formed substantially on all six of its surfaces except for the areas where the input and output electrodes are formed.

The dielectric duplexer configured as described above operates in the following way. The inner conductors 3*b*, 3*c*, 3*d*, and 3*e* are comb-line coupled with each other, and the inner conductors 3*f*, 3*g*, and 3*h* are also comb-line coupled with each other. The output inner conductor 8*a* formed in the output hole 7*a* is coupled with the inner conductors 3*a* and 3*b*, the input-and-output inner conductor 8*b* is coupled with the inner conductor 3*e* and 3*f*, and the input inner conductor 8*e* is coupled with the inner conductor 3*h* and 3*i*. With this arrangement, the inner conductors 3*a* and 3*i* work as trap circuits. Therefore, the portion between the electrodes 5*a* and 5*b* serves as a bandpass filter having a trap, and the portion between the electrodes 5*b* and 5*c* serves as a bandpass filter having a trap.

The ground hole 9*a* breaks the coupling between the inner conductors 3*a* and 3*b* by its blocking effect, the ground hole 9*b* breaks the coupling between the inner conductors 3*e* and 3*f* by its blocking effect, and the ground hole 9*c* breaks the coupling between the inner conductors 3*h* and 3*i* by its blocking effect.

In the embodiment shown in FIG. 11(A) to FIG. 11(D), by making the large-sectional-area portions with the cross-sectional shape of an elongated circle, and shifting the axes of the large-sectional-area portions and the small-sectional-area portions with respect to each other, the self-capacitance of the large-sectional-area portions and the mutual capacitance between adjacent resonator holes are specified to set the degree of coupling between the adjacent resonators. The degree of coupling between the input-and-output inner conductors and inner conductors adjacent thereto is also specified. Therefore, a dielectric duplexer having the desired filter characteristics is easily obtained.

The structure of a dielectric duplexer according to a seventh embodiment will be described below by referring to FIG. 12(A) to FIG. 12(D).

FIG. 12(A) to FIG. 12(D) show projective views of the dielectric duplexer. FIG. 12(A) is a plan, FIG. 12(B) is an elevation, FIG. 12(C) is a bottom view, and FIG. 12(D) is a right-hand side view of the dielectric duplexer. This dielectric duplexer is formed of a rectangular-parallelepiped dielectric block 1 in which various holes and conductors are made. Specifically, the block is provided with resonator holes 2*a*, 2*b*, and 2*c* for a transmission filter used when the dielectric duplexer serves as an antenna multiplexer, resonator holes 2*d*, 2*e*, and 2*f* for a receiving filter used when the dielectric duplexer serves as an antenna multiplexer, and input and output holes 7*a* and 7*b*.

As shown in FIG. 12(B), each resonator hole is of a step type in which the inner diameter changes approximately between the upper half and the lower half, as shown in FIG. 12(B), and its inner surface is provided with an inner conductor. Inner conductors 3*a*, 3*c*, 3*d*, 3*e*, and 3*f* are formed on the inner surfaces of the resonator holes 2*a*, 2*c*, 2*d*, 2*e*, and 2*f*, respectively. The resonator hole 2*b* is of a step type having a large inner diameter portion in the upper half of FIG. 12(B) and it has an inner conductor on its inner surface. In each inner conductor, a gap 6 where no conductor is formed is provided near the end of the large-sectional-area side of the step hole and this gap serves as an open end of the corresponding resonator.

Input-and-output inner conductors 8*a* and 8*b* are formed on the inner surfaces of the input and output holes 7*a* and 7*b*. In this embodiment, the input-and-output inner conductors 8*a* and 8*b* correspond to an input electrode and an input/output electrode according to the present invention, respectively.

Ground holes 9*a* and 9*b* are also shown in the figure. They are straight, have a constant inner diameter, and are provided with conductors on their whole inner surfaces. On outside surfaces of the dielectric block 1, input and output electrodes 5*a* and 5*b* continuously connected to the input-and-output inner conductors 8*a* and 8*b*, respectively, and an input/output electrode 5*c* coupled with the inner conductor 3*f* are formed, and an outer conductor 4 is formed substantially on all six of the outer surfaces except for the areas where these input and output electrodes are formed. In the present embodiment, the input/output electrode 5*c* corresponds to an output electrode according to the present invention.

The dielectric duplexer configured as described above operates in the following way. The inner conductors formed on the resonator holes 2*d*, 2*e*, and 2*f* are comb-line coupled with each other. Therefore, the portion between the input and output electrodes 5*b* and 5*c* serves as a bandpass filter. The inner conductor 3*c* is inter-digitally coupled with the input-and-output inner conductors 8*a* and 8*b*. The inner conductors formed on the resonator holes 2*a* and 2*b* are also inter-digitally coupled with the input-and-output inner conductors 8*a* and 8*b*. With this arrangement, the portions between the input and output electrodes 5*a* and 5*b* are $\pi/2$-phase-shift coupled with each other through the inner conductor 3*c* and they serve as a band-block filter formed of a two-stage trap circuit. The ground hole 9*a* breaks the coupling between the inner conductors of the resonator holes 2*a* and 2*b* by its blocking effect, and the ground hole 9*b* breaks the coupling between the inner conductor of the resonator hole 2*b* and the input-and-output inner conductor 8*b* by its blocking effect.

As described above, since the inner conductor 3*c* serving as the final stage of the transmission filter is $\pi/2$-phase-shift coupled with the input-and-output inner conductor 8*b* by inter-digital coupling, the impedance of the transmission filter viewed from the input-and-output inner conductor 8*b* is substantially open in an attenuation band of the transmission filter. Therefore, a signal received from the antenna is not input to the transmission filter and is only led to the receiving filter.

Also in the seventh embodiment, by making the large-sectional-area portions in the cross-sectional shape of an elongated circle, and shifting the locations of the axes of the large-sectional-area portions and/or the small-sectional-area portions, the self-capacitance of the large-sectional-area portions and the mutual capacitance between adjacent resonator holes are specified to set the degree of coupling between the adjacent resonators. The degree of coupling between the input-and-output inner conductors and the inner conductors adjacent thereto is also specified. Therefore, a dielectric duplexer having the desired filter characteristics is easily obtained.

In the above embodiments, the large-sectional-area portions have an elongated-circular cross-section. However, if it has an elliptical cross-section, a cross-section similar in shape to an ellipse, or another elongated cross-section such as a rectangle, the same operations and the same advantages are obtained.

Also, although the steps are substantially halfway along the length of the step-type resonator holes in the disclosed embodiments, this is not an essential feature of the invention and the steps could be at other locations as well.

Figure 13:
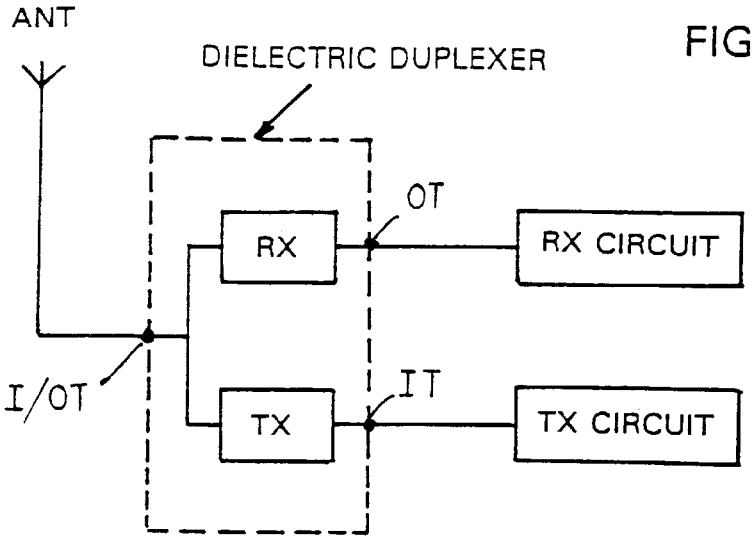
FIG. 13 shows a block diagram of a radio transceiver including a dielectric duplexer according to an eighth embodiment of the present invention.
Figure 14A:
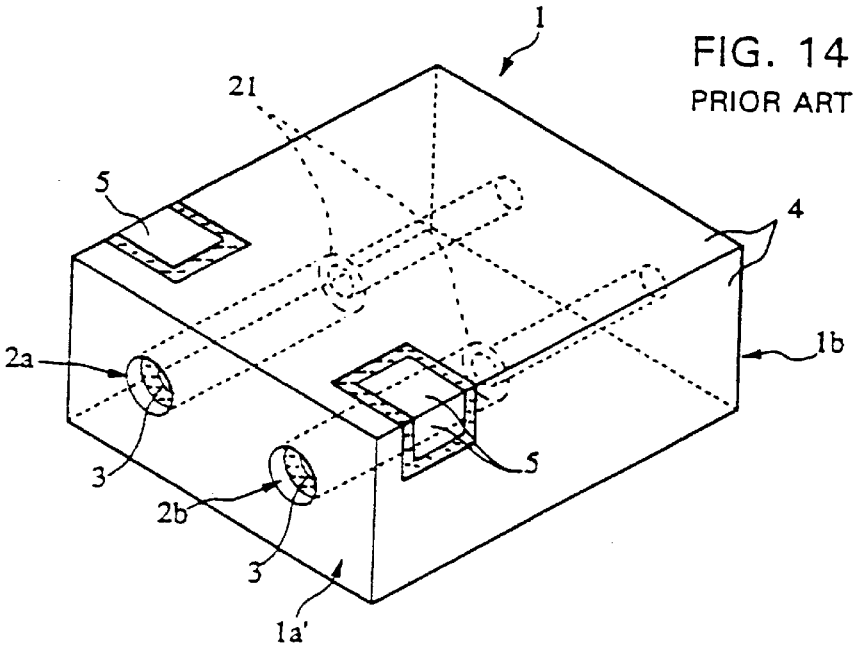
FIG. 14(A) PRIOR ART
FIG. 14(A) and FIG. 14(B) show a perspective view and an elevation of a conventional dielectric filter.
Figure 14B:
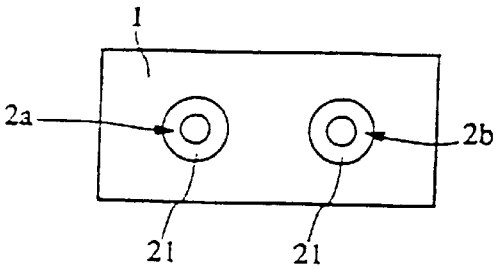
FIG. 14(B) PRIOR ART

FIG. 13 shows a block diagram of a radio transceiver including the dielectric duplexer of the present invention.

In the radio transceiver, a transmission filter portion TX of the dielectric duplexer is connected to a transmission (TX) circuit via an input terminal IT, and the receiving filter portion RX of the dielectric duplexer is connected to a receiving (RX) circuit via an output terminal OT. Further, both the transmission filter portion TX and the receiving filter portion RX are connected to an antenna ANT via an input/output terminal I/OT.

A signal transmitted to the radio transceiver is received by the antenna ANT, and a signal representative thereof is applied to the receiving filter portion RX. The receiving filter portion RX generates a filtered signal which is applied to the receiving (RX) circuit. The receiving (RX) circuit performs functions such as down-conversion and demodulation of the receiving signal, as is conventional. The transmission (TX) circuit is operative to modulate and up-convert in frequency a signal to be transmitted by the radio transceiver, and to generate a signal which is applied to the transmission filter portion TX. The transmission filter portion TX is operative to generate a filtered signal which is applied to the antenna ANT to be transmitted therefrom.

While the invention has been particularly shown and described with reference to preferred embodiments thereof, it will be understood by those skilled in the art that the foregoing and other changes in form and details may be made therein without departing from the spirit of the invention.

What is claimed is:

1. A dielectric filter, comprising:

a dielectric block having two ends opposed to each other;

an outer conductor disposed on an outer surface of said dielectric block;

a plurality of resonator holes extending between said two ends of said dielectric block, each hole having a respective inner surface on which an inner conductor is provided, each inner conductor being connected to said outer conductor at one end to form a short-circuited end of the corresponding hole, and being isolated from said outer conductor at the other end to form an open-circuited end of the corresponding hole;

at least one of said resonator holes comprising a large-sectional-area portion and a small-sectional-area portion arranged so that said at least one hole has different respective inner diameters at said open-circuited end and said short-circuited-end; and the cross-sectional shape of said large-sectional-area portion being an elongated shape having a longitudinal axis, said longitudinal axis being slanted with respect to a plane in which said plurality of resonator holes are arranged.

2. The dielectric filter according to claim 1, wherein:

said small-sectional-area portion has a central axis which is shifted from a central axis of said large-sectional-area portion such that said small-sectional-area portion is eccentric to said large-sectional-area portion.

3. A method of manufacturing a dielectric filter comprising the steps of:

forming a dielectric block having two ends opposed to each other;

forming an outer conductor on an outer surface of said dielectric block;

forming a plurality of resonator holes extending between said two ends of said dielectric block, each hole having a respective inner surface;

forming a respective inner conductor on each said inner surface, each inner conductor being connected to said outer conductor at one end to form a short-circuited end of the corresponding hole, and being isolated from said outer conductor at the other end to form an open-circuited end of the corresponding hole;

forming at least one of said resonator holes with a large-sectional-area portion and a small-sectional-area portion arranged so that said at least one hole has different respective inner diameters at said open-circuited end and said short-circuited-end;

the cross-sectional shape of said large-sectional-area portion being an elongated shape which defines a longitudinal axis, said longitudinal axis being angled with respect to a plane in which said plurality of resonator holes are arranged;

adjusting the self-capacitance of said at least one resonator hole and the mutual capacitance between a pair of adjacent said resonator holes including said at least one resonator hole by changing the angle of the longitudinal axis of the cross-section of the large-sectional-area portion with respect to said plane in which said plurality of resonator holes are arranged.

4. A method of manufacturing a dielectric filter according to claim 3, further comprising the steps of:

forming said small-sectional-area portion with a central axis which is shifted from a central axis of said large-sectional-area portion such that said small-sectional-area portion is eccentric to said large-sectional-area portion; and adjusting the self-capacitance of said at least one resonator hole and the mutual capacitance between a pair of adjacent said resonator holes including said at least one resonator hole by changing the amount by which the central axis of said small-sectional-area portion is shifted from the central axis of said large-sectional-area portion.

5. A dielectric duplexer comprising:

a dielectric block having two ends opposed to each other;

an outer conductor disposed on an outer surface of said dielectric block;

a plurality of resonator holes extending between said two ends of said dielectric block, each hole having a respective inner surface on which an inner conductor is provided, each inner conductor being connected to said outer conductor at one end to form a short-circuited end of the corresponding hole, and being isolated from said outer conductor at the other end to form an open-circuited end of the corresponding hole;

at least one of said resonator holes comprising a large-sectional-area portion and a small-sectional-area portion arranged so that said at least one hole has different respective inner diameters at said open-circuited end and said short-circuited-end;

the cross-sectional shape of said large-sectional-area portion being an elongated shape which defines a longitudinal axis, said longitudinal axis being slanted with respect to a plane in which said plurality of resonator holes are arranged;

an input/output electrode, an input electrode, and an output electrode respectively provided on the outer surface of said dielectric block;

a first group of said resonator holes being disposed between said input/output electrode and said input electrode to define a transmission filter; and a second group of said resonator holes being disposed between said input/output electrode and said output electrode to define a receiving filter.

6. A dielectric duplexer according to claim 5, wherein:

said small-sectional-area portion has a central axis which is shifted from a central axis of said large-sectional-area portion such that said small-sectional-area portion is eccentric to said large-sectional-area portion.

7. A method of manufacturing a dielectric duplexer comprising the steps of:

forming a dielectric block having two ends opposed to each other;

forming an outer conductor on an outer surface of said dielectric block;

forming a plurality of resonator holes extending between said two ends of said dielectric block, each hole having a respective inner surface;

forming an inner conductor on each said inner surface, each inner conductor being connected to said outer conductor at one end to form a short-circuited end of the corresponding hole, and being isolated from said outer conductor at the other end to form an open-circuited end of the corresponding hole;

forming at least one of said resonator holes with a large-sectional-area portion and a small-sectional-area portion arranged so that said at least one hole has different respective inner diameters at said open-circuited end and said short-circuited-end;

the cross-sectional shape of said large-sectional-area portion being an elongated shape which defines a longitudinal axis, said longitudinal axis being angled with respect to a plane in which said plurality of resonator holes are arranged;

forming an input/output electrode, an input electrode, and an output electrode on the outer surface of said dielectric block;

arranging a first group of said resonator holes disposed between said input/output electrode and said input electrode to define a transmission filter;

arranging a second group of said resonator holes disposed between said input/output electrode and said output electrode to define a receiving filter;

adjusting the self-capacitance of said at least one resonator hole and the mutual capacitance between a pair of adjacent said resonator holes including said at least one resonator hole by changing the angle of the longitudinal axis of the cross-section of the large-sectional-area portion with respect to said plane in which said plurality of resonator holes are arranged.

8. A method of manufacturing the dielectric duplexer of claim 7, further comprising the steps of:

forming said small-sectional-area portion with a central axis which is shifted from a central axis of said large-sectional-area portion such that said small-sectional-area portion is eccentric to said large-sectional-area portion; and adjusting the self-capacitance of said at least one resonator hole and the mutual capacitance between a pair of adjacent said resonator holes including said at least one resonator hole by changing the amount by which the central axis of said small-sectional-area portion is shifted from the central axis of said large-sectional-area portion.

9. A radio transceiver including a dielectric duplexer, the duplexer comprising:

a dielectric block having two ends opposed to each other;

an outer conductor disposed on an outer surface of said dielectric block;

a plurality of resonator holes extending between said two ends of said dielectric block, each hole having a respective inner surface on which an inner conductor is provided, each inner conductor being connected to said outer conductor at one end to form a short-circuited end of the corresponding hole, and being isolated from said outer conductor at the other end to form an open-circuited end of the corresponding hole;

at least one of said resonator holes comprising a large-sectional-area portion and a small-sectional-area portion arranged so that said at least one hole has different respective inner diameters at said open-circuited end and said short-circuited-end;

the cross-sectional shape of said large-sectional-area portion being an elongated shape which defines a longitudinal axis, said longitudinal axis being slanted with respect to a plane in which said plurality of resonator holes are arranged;

an input/output electrode, an input electrode, and an output electrode provided on the outer surface of said dielectric block;

a first group of said resonator holes being disposed between said input/output electrode and said input electrode to define a transmission filter;

a second group of said resonator holes being disposed between said input/output electrode and said output electrode to define a receiving filter;

said radio transceiver further comprising:

a transmission circuit for generating a transmission signal and being connected to said input electrode;

a reception circuit for receiving a reception signal and being connected to said output electrode;

an antenna terminal connected to said input/output electrode for receiving an antenna.

10. A radio transceiver as recited in claim 9, wherein said small-sectional-area portion has a central axis which is shifted from a central axis of said large-sectional-area portion such that said small-sectional-area portion is eccentric to said large-sectional-area portion.

11. A radio transceiver as in claim 10, further comprising an antenna connected to said input/output electrode via said antenna terminal.

12. A radio transceiver as in claim 9, further comprising an antenna connected to said input/output electrode via said antenna terminal.

* * * * *